US005115656A

United States Patent [19]

Kümmerling et al.

[11] Patent Number: 5,115,656

[45] Date of Patent: May 26, 1992

[54] METHOD AND APPARATUS FOR MANUFACTURING MEDIUM-WALLED AND THIN-WALLED SEAMLESS PIPES

[75] Inventors: Rolf Kümmerling, Duisburg; Manfred Bellmann, Ratingen; Horst Biller, Mülheim, all of Fed. Rep. of Germany

[73] Assignee: Mannesmann Aktiengesellschaft, Düsseldorf, Fed. Rep. of Germany

[21] Appl. No.: 665,259

[22] Filed: Mar. 6, 1991

[30] Foreign Application Priority Data

Mar. 6, 1990 [DE] Fed. Rep. of Germany ..... 4007406

[51] Int. Cl.[5] ..... B21B 19/10

[52] U.S. Cl. ..... 72/96

[58] Field of Search ..... 72/96, 98

[56] References Cited

U.S. PATENT DOCUMENTS

| | | | |
|---|---|---|---|
| 1,964,507 | 6/1934 | Diescher | 72/96 |
| 2,005,125 | 6/1935 | Bannister | 72/96 |
| 2,334,853 | 11/1943 | Wiley | 72/96 |
| 4,392,369 | 7/1983 | Ramdohr et al. | 72/98 |

*Primary Examiner*—Lowell A. Larson

*Attorney, Agent, or Firm*—Cohen, Pontani, Lieberman & Pavane

[57] ABSTRACT

A method of manufacturing seamless pipes having medium-thick or thin walls from an elongated hollow body of limited length which is reshaped by rolling to the desired final dimension, as well as a rolling apparatus for the carrying out of the method. This method of manufacturing seamless pipes having medium-thick or thin walls from an elongated hollow body is characterized by the fact that, with only one rolling pass the diameter of the hollow body is significantly reduced and by using an inner tool the inner surface is smoothed with only a slight change in wall thickness. Further, this method allows for the rolling of the axis of the hollow body to align with the axis of rolling. The rolling apparatus includes an inner tool which cooperates with two rolls to reduce the diameter of the pipe to a desired final dimension, the two rolls each having an inlet part, a feed part, a reducing part inclined at an angle within the range of more than 2° and up to 10° and adjoining same, with a transition in the form of a circular arc, and a substantially cylindrical reeler with a difference angle to the working part of the inner tool within the range of 0° to 1°, followed by an outlet part.

12 Claims, 3 Drawing Sheets

METHOD AND APPARATUS FOR MANUFACTURING MEDIUM-WALLED AND THIN-WALLED SEAMLESS PIPES

FIELD OF THE INVENTION

The present invention relates to a method of manufacturing seamless pipes having medium-thick or thin walls from an elongated hollow body of limited length which is reshaped by rolling to the desired final dimension, as well as a rolling apparatus for carrying out the method.

BACKGROUND OF THE INVENTION

There is an extremely great need for seamless pipes within the diameter range of 7 inches (177.8 mm) up to 26 inches (660 mm) with a ratio of the diameter to the wall thickness being within the range of 15:1 to 50:1. Such seamless pipes are predominately used, for example, in oil field applications, e.g. as drill pipes, delivery pipes or liner pipes. In this connection, the manufacture of seamless pipes of high quality, i.e., with narrow tolerances of wall thickness and diameter as well as a good surface, is relatively difficult and requires a corresponding expense for equipment. This is true in particular of thin-walled pipes having a ratio of diameter to wall thickness of more than 25:1. The methods of rolling heretofore used for the manufacture of such seamless pipes are on the one hand the piercing-rolling method and on the other the pilger rolling method. With respect to the general design of the two methods of rolling, reference is had to the Stahlrohr-Handbuch, 10th Edition, 1986, particularly pages 128 and 133.

The disadvantage of the piercing-rolling method is that in order to equalize the beads in wall-thickness coming from the lengthwise rolling and to obtain acceptable roundness, two parallel travelling smoothing rolls (reelers) and sizing or reducing rolls for reasons of output must be arranged behind the piercing rolling mill. Ordinary reelers are developed in the entrance part either as a barrel or divergent cone with an angle of reduction of up to about 2° (Hutnicke listy 38 (1983) No. 11, Pages 779–782).

In the case of the last mentioned rolling step, the pre-pipe has been slightly widened by the reeling to be rolled to the desired final dimension with a corresponding reduction of its diameter. Since in such a sizing mill the decrease per stand amounts to about 2 to 4 percent, a large number of stands are required to have an ordinary standardization of parent pipes in order to achieve the corresponding decreases in diameter. Many stands, however, mean high investment expenses and a corresponding stocking of rolling stands.

In the pilger rolling method in which, for reasons of expense, standardization of the parent pipes is generally dispensed with, the last reshaping step, usually, is only a calibration ordinarily with 3 stands, but the quality of the surface, and particularly the tolerances in the wall thickness of the pilger-produced pipe, in most cases do not satisfy the increased demands.

SUMMARY OF THE INVENTION

It is an object of the present invention to provide a method for the manufacture of seamless pipes of medium-thick and thin walls having a ratio of diameter to wall thickness within the range of 15:1 to 50:1, with which it is possible, starting from an elongated hollow body, to produce, at the smallest possible expense for equipment, the desired final dimension with a good quality of surface while maintaining the prescribed dimensional tolerances.

This object is achieved by a method of manufacturing seamless pipes of medium-thick and thin walls from an elongated hollow body of limited length where the method reshapes by rolling to the desired final dimension. The diameter of the hollow body is significantly reduced with only one rolling pass and with only slight change in wall thickness, the reeling of the inner surface takes place and upon the rolling the axis of the hollow body is aligned with the axis of rolling.

The method of rolling in accordance with the invention combines reeling and reduction of diameter in one operation and thus can be referred to as reduction reeling and in principle can also be applied to cold rolling. The elongated hollow body which may be produced by various conventional methods is in accordance with the invention, reshaped into the desired final dimension by rolling, insofar as possible, in only one roll pass and therein significantly reducing the diameter and at the same time smoothing the inner surface with the use of an inner tool. In accordance with the invention, this objective can be realized using a single rolling unit if suitable overall conditions are present, i.e. the starting material must be a hollow body which is ideal with respect to tolerances and quality of surface and which is then rolled to a dimension which represents an optimum with respect to tolerances and roundness, so that subsequent calibration can be dispensed with.

Otherwise, if desired, a further rolling method may be used after the reduction reeling. This rolling method is substantially a calibration in which in addition to rounding, a slight reduction in diameter is effected for precisely establishing the desired final diameter. This variant of the method of the invention has great advantages over the conventional method of rolling. If one proceeds from the basis that, as already mentioned, the decrease in diameter per stand in a conventional dimension-reducing rolling mill in the last step, for instance a piercing rolling mill, is about 2 to 4%, then, for a reduction in diameter of 20% upon the reduction reeling, at least 5 stand positions together with the corresponding spare stands would be saved. The further advantage is that upon the reduction reeling the degree of reduction can also be so adjusted that the decrease in diameter is practically zero, or that the entering hollow body is widened as in conventional reeling.

Thus, this method is very adaptable and can be used for different requirements. The method of rolling of the invention is particularly advantageous when, seen in the direction of rolling, the entering hollow body is first reduced in diameter and, directly following this, the reeling of the inner surface takes place. This sequence has the advantage that depending on the utilization of the reducing part, reeling can be effected both with greater or lesser reduction, as well as conventionally. Without departing from the inventive concept, one can, in principle, also reverse the sequence, i.e. reel first and then reduce. However, this has the disadvantage that one has no freedom with respect to the degree of reduction because reeling and reduction must always be effected simultaneously.

In order to improve the quality of the inner surface, the inner tool is continuously displaced in longitudinal direction during the entire rolling process. The advantage to this method is that the scale obtained upon the customary hot rolling cannot build up at any given place and thus lead to disturbances in the rolling process.

Alternatively, the inner tool may be displaced only during a given phase of the rolling. These given phases of the rolling are preferably at the end rolling and the initial rolling, which are particularly critical to the distribution of the forces in the roll nip and are supported by the displacement of the inner tool.

The measure of displacing the inner tool upon the start rolling or end rolling has the purpose of avoiding start rolling or end rolling plugs. If the method is limited to these phases, then during the remaining rolling time one has the condition of a stationary inner tool with the danger of the scale building up. To avoid this, the inner tool is preferably displaced during the remaining time. Preferred embodiments of a rolling apparatus for carrying out the above methods according to the invention will now be described with reference to FIGS. 1-3.

Other features of the present invention will become apparent from the following detailed description considered in conjunction with the accompanying drawings. It is to be understood, however, that the drawings are designed solely for purposes of illustration and not as a definition of the limits of the invention, for which references should be made to the appended claims.

BRIEF DESCRIPTION OF THE DRAWINGS

The apparatus and the method of the invention are described below in detail with reference to the accompanying simplified, diagrammatic drawings, wherein.

DETAILED DESCRIPTION OF PREFERRED EMBODIMENTS

Figure 1:
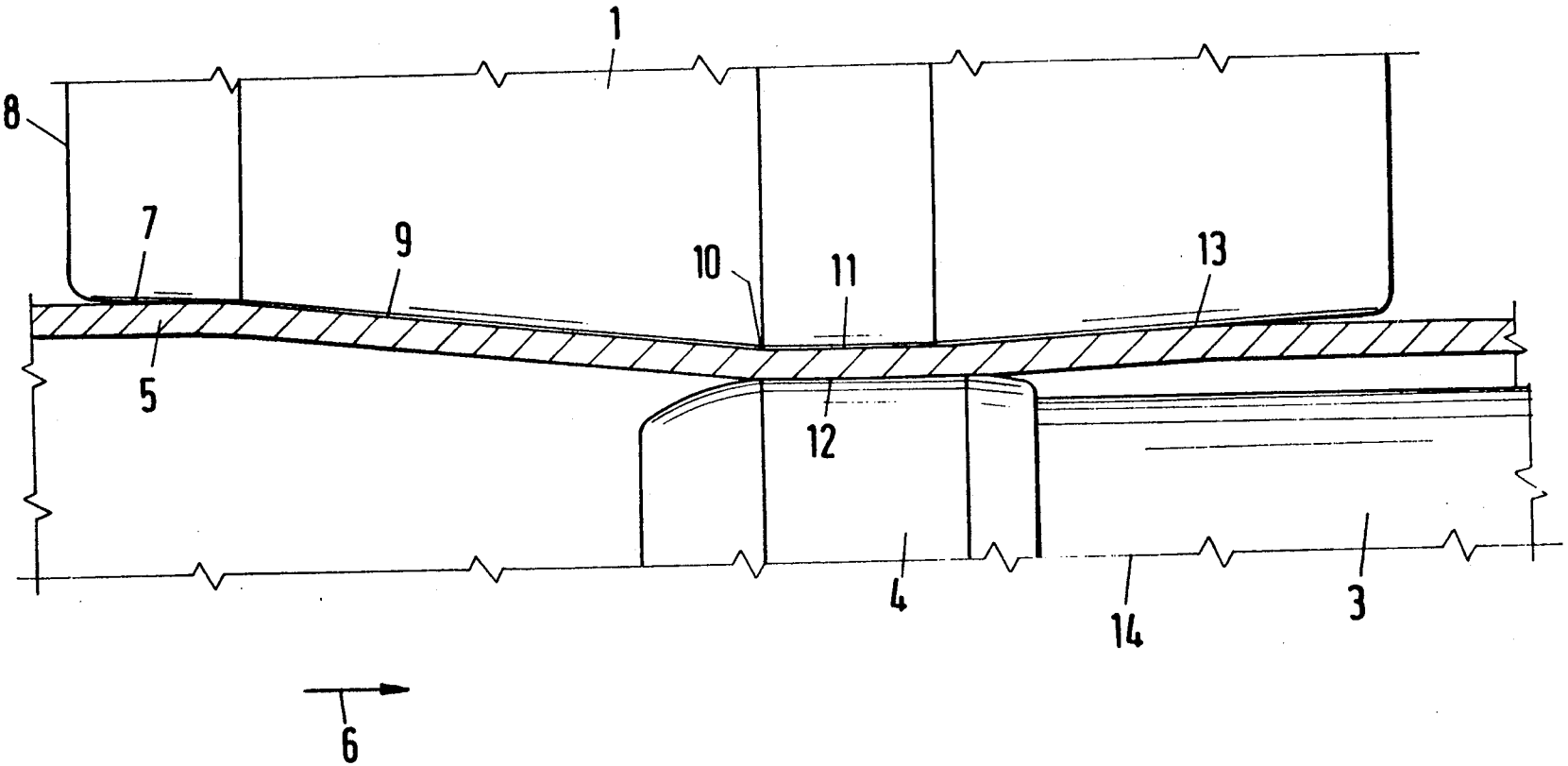
FIG. 1 is a half longitudinal cross-sectional view through the rolling device of the invention during the rolling.

FIG. 1 shows, in a half longitudinal partial cross-sectional view, a rolling device of the invention during the rolling process. The rolling device consists of two rolls 1, 2 driven in the same direction and inclined by a transport angle to the roll axis. The second roll 2, as well as the guides which are arranged in a plane which is 90° from the rolling plane are not shown. Furthermore, the rolling device has an inner tool 4 which is fastened on a holding rod 3. The hollow body 5 to be rolled is shown in full roll engagement. The roll 1 of the invention has various sections which will be explained in detail below. Seen in the direction of rolling, which is indicated by the arrow 6, the roll 1 has at the start a feed part 7 which is rounded, that passes into the entrance-side end surface 8 of the roll 1. The feed part 7 is developed in this embodiment as a divergent cone with a feed angle of about 1°. The feed part 7 is followed by a reducing part 9 with a reduction angle within the range of more than 2° up to 10°, more preferably 3° to 5°. In this section, the diameter of the entering hollow body 5 is significantly reduced. This is followed with a circular arc-shaped transition 10, by an approximately cylindrical reeler part 11. This reeler part 11 forms with the working part 12 of the inner tool 4, a difference angle within the range of 0° to 1°. In the preferred embodiment, the length of the working part 12 of the inner tool 4 is greater than the length of the reeler part 11 of the rolls 1, 2. Due to the greater length of the working part 12 of the inner tool 4 as compared with the reeler part 11 of the rolls 1, 2, the inner tool 4 need not be positioned so accurately. Furthermore, the wear of the inner tool 4 is reduced since by changing the position of the inner tool 4 between two successive rolling periods, the maximum loading each time lies at a different point on the working part 12. The reeler part 11 is followed by an outlet part 13, the object of which is to round the emerging hollow body 5.

The feed part 7 serves as an initial turning aid and facilitates the initial rolling process. Particularly in the case of thin-walled pipes, there is a desirable additional torque produced by the conical feed part 7 which assists in bringing the hollow body 5 to be rolled up to the reeler part 11 without it getting stuck in the reducing part 9 due to the ovalness produced by the reduction.

The guidance, not shown, is conventional and includes two guide straight-edges opposite each other in order to close the caliber. In one embodiment, the axes of the roll 1 and corresponding roll 2 (not shown) may have a spread angle with respect to the roll axis 14. In this embodiment, however, the length of the contour of the rolls 1, 2 with respect to the roll axis 14 would remain the same as shown in FIG. 1.

Figure 2A:
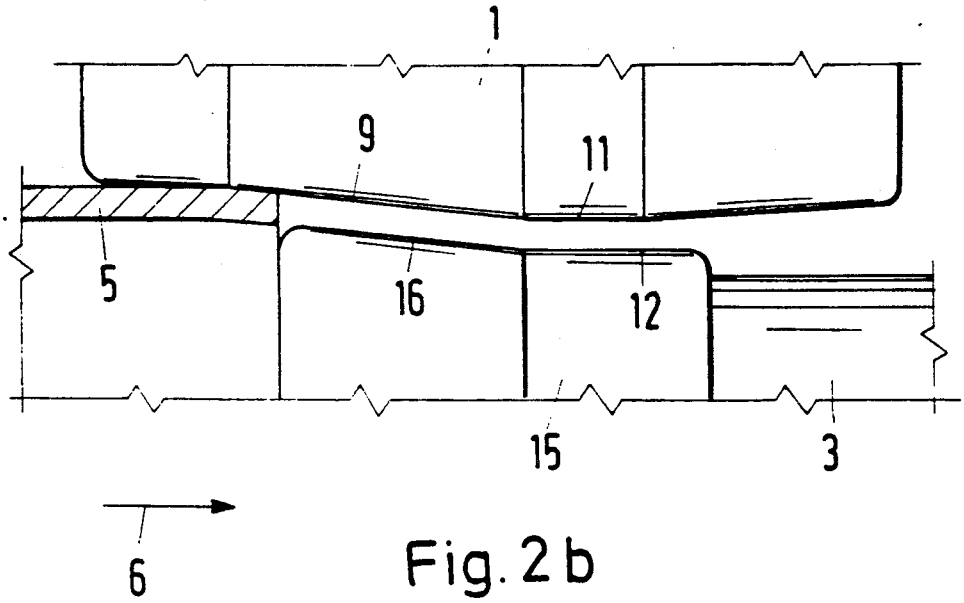
FIGS. 2*a*-*c* are half longitudinal sectional views through the rolling device with a displaceable inner tool during different phases of the rolling.
Figure 2B:
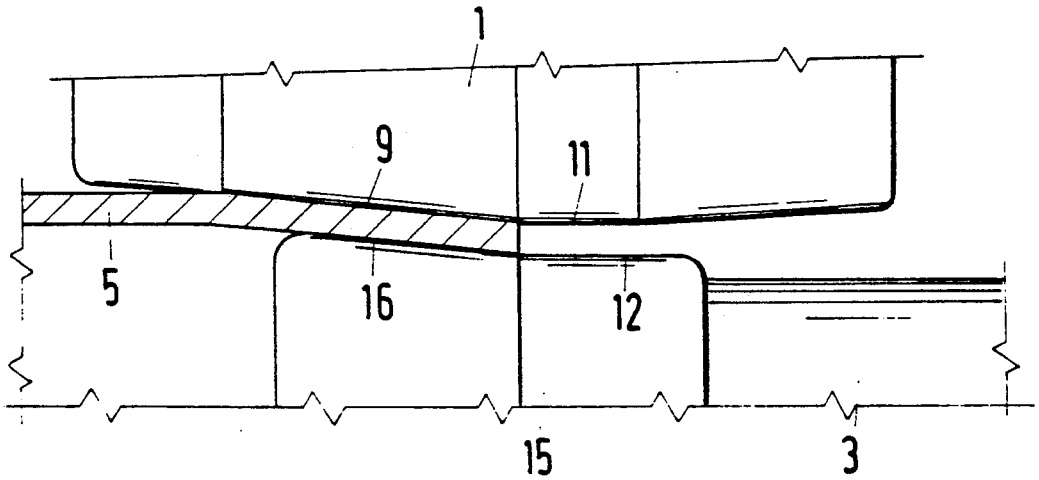
Figure 2C:
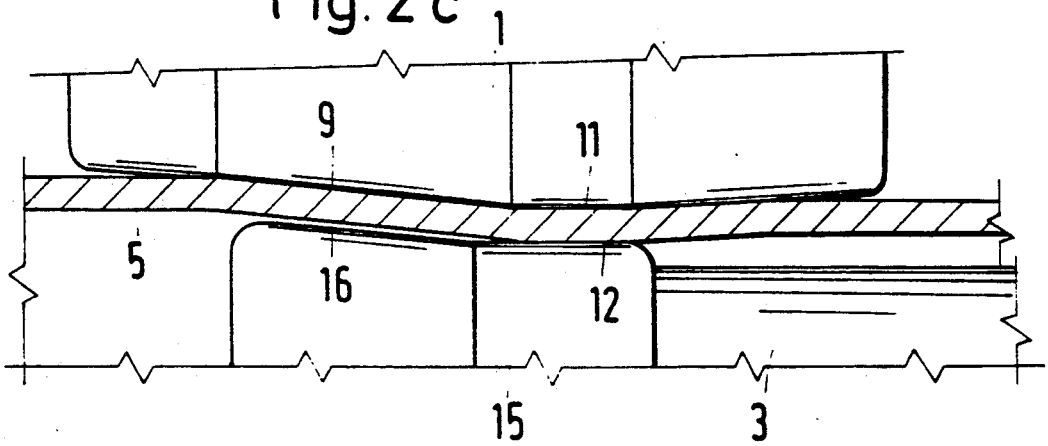

FIG. 2, in the same way as FIG. 1, shows half a longitudinal cross-sectional view through the rolling device, but with a displaceable inner tool 15 during different rolling phases. In this case, the same reference numerals as in FIG. 1 have been used for identical parts. However, the inner tool 15 shown in FIGS. 2*a*-*c* has two different sections. The working part 12' is developed cylindrically as in the case of the conventional inner tool 4, but, in contradistinction to FIG. 1, there is furthermore provided in front of it a conically developed initial rolling part 16. The cone angle of this initial rolling part 16 is practically equal to the cone angle of the reducing part 9 of roll 1. During the phase of initial rolling shown in FIG. 2*a*, the inner tool 15 is so adjusted with respect to the roll 1 that the transition from the working part 12' to the initial rolling part 16 of the inner tool 15 lies in the plane of the transition from the reeler part 11 to the reducing part 9 of the roll 1. The phase of the initial rolling is completed, as shown in FIG. 2*b*, when the hollow body 5 reaches the transfer plane described. Thereupon, as shown in FIG. 2*c*, the inner tool 15 is advanced contrary to the rolling direction 6 to such an extent that the transfer region of the inner tool 15 lies in the reducing part 9 of the roll and the incoming hollow body 5 no longer comes to rest against the initial rolling part 16 of the inner tool 15.

Figure 3:
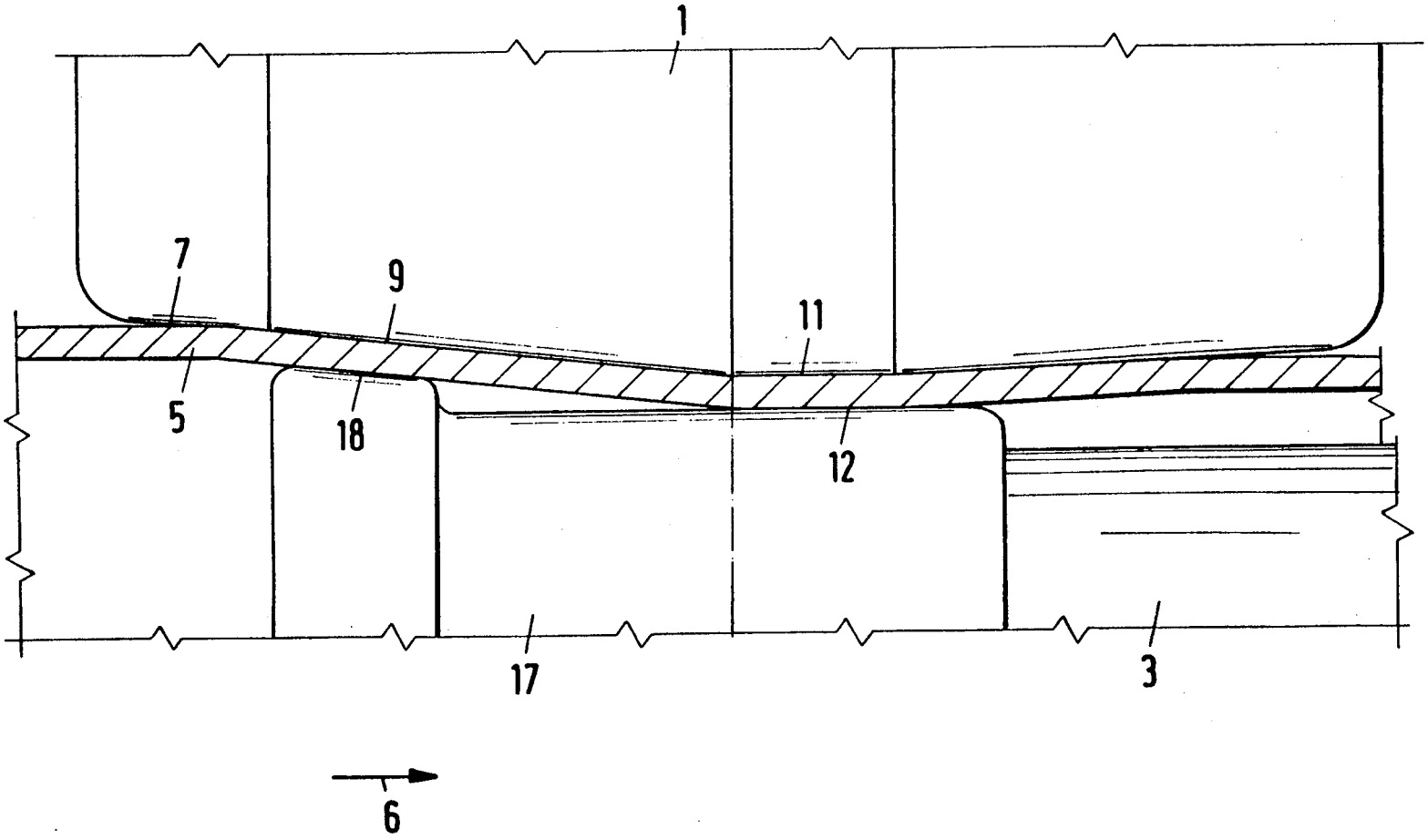
FIG. 3 is a half longitudinal cross-sectional view through the rolling device of the invention during the rolling illustrating a different embodiment of the inner tool.

FIG. 3 shows another embodiment of an inner tool 17. In this case also, the same reference numerals are used for the identical parts as in FIG. 1. Differing from FIGS. 1 and 2, this inner tool 17 has a cylindrical working part 12" which is extended so far in the direction opposite to the direction of rolling that it extends over half the length of the reducing part 9 of the roll 1. Adjoining this, with a radial jump, there is a conically developed initial rolling part 18 which has a cone angle that is approximately equal to the cone angle of the reducing part 9 of the roll 1. This initial rolling part 18 extends in longitudinal direction up to the start of the reducing part 9 of the roll 1 or up to the transition 10 from the reducing part 9 to the feed part 7 of the roll 1.

This alternative embodiment of the inner tool 17 has the advantage that an exact agreement between the beginning of the reeler part 11 of the roll 1 and the reeler part 11 of the inner tool 17 is not necessary. One thus obtains more room for adjusting the position of the inner tool 17. In particular, differences over the length in the circumferential speed of the material, which cannot be avoided for each adjustment in the event of the same working length in the reducing part of the roll 1 and inner tool 17, make themselves clearly less perceptible. This means that the danger of an impermissible twisting of the hollow body 5 to be rolled around the longitudinal axis is clearly reduced upon reduction with contact with the inner tool 17.

In case of reversal of the method which is possible in principle, i.e., first reeling and then reducing, no additional torque is available when the end of the hollow body 5 has left the reeler part 11 with the result that end plugs can occur in the case of thin-walled pipes. These end plugs can be avoided if one provides a conical final rolling part on the inner tool 4 of FIG. 1, for example. However, one could not shift opposite the direction of rolling in order to avoid the building up of scale during the rolling.

The method and apparatus of the invention can be varied in the manner that the rolls 1, 2 of the rolling device not only have the customary angle of transport, but also have an angle of spread with respect to the rolling axis 14. This variant is particularly advantageous when the point of intersection of the axes of the rolls 1, 2 with the rolling axis 14 lies behind the rolling mill, as seen in the direction of rolling 6, in which case the transport angle is ideally set to zero. With this arrangement, an optimum is obtained when the size of the spread angle is so selected that, for the average diameter of the predetermined region of dimensions in the reducting part 9, the circumferential speed of the rolls 1, 2 decreases proportionally with the decrease in the diameter of the hollow body 5. In this way, for zero slip and with linear contact of the roll 1 and hollow body 5, the same angular speed results for the hollow body 5 for each point on its axis. Expressed differently, by this preferred spread angle, the change in the circumferential speed of the rolls 1, 2 over the length is so optimized that the roll 1 and hollow body 5 to be rolled, roll approximately on each other like the teeth of a gearing and, as a result, the material being rolled is twisted as little as possible around its longitudinal axis.

The following preferred variants exist as possible uses for the method of the invention:

- in the piercing method, as a replacement for the conventional reeler behind the piercing stand;
- in the pilger rolling method behind the pilger stand as an additional step of the method with the said advantages with respect to the surface and the tolerances;
- directly behind a piercer without further reducing the unit.

In accordance with the invention, the elongated hollow body which may be produced by various conventional methods is reshaped into the desired final dimension by rolling, insofar as possible, in only one roll pass and therein significantly reducing the diameter and at the same time smoothing the inner surface with the use of an inner tool. In accordance with the invention this may be achieved using a single rolling unit if suitable overall conditions are present, i.e. the starting material must be a hollow body which is ideal with respect to tolerances and quality of surface and which is then rolled to a dimension which represents an optimum with respect to tolerances and roundness, so that subsequent calibration can be dispensed with.

Alternatively, in accordance with the invention, a further rolling method may be used after the reduction reeling. This rolling method is substantially a calibration in which in addition to rounding, a slight reduction in diameter is effected for precisely establishing the desired final diameter. This variant of the method of the invention has great advantages over the conventional method of rolling. If one proceeds from the basis that, as already mentioned, the decrease in diameter per stand in a conventional dimension-reducing rolling mill in the last step, for instance a piercing rolling mill, is about 2 to 4%, then, for a reduction in diameter of 20% upon the reduction reeling, at least 5 stand positions together with the corresponding spare stands would be saved. The further advantage is that upon the reduction reeling the degree of reduction can also be so adjusted that the decrease in diameter is practically zero, or that the entering hollow body is widened as in conventional reeling. Thus, this method is very adaptable and can be used for different requirements. The method of rolling of the invention is particularly advantageous when, seen in the direction of rolling, the entering hollow body is first reduced in diameter and, directly following this, the reeling of the inner surface takes place. This sequence has the advantage that depending on the utilization of the reducing part, reeling can be effected both with greater or lesser reduction, as well as conventionally. Without departing from the inventive concept, one can, in principle, also reverse the sequence, i.e. reel first and then reduce. However, this has the disadvantage that one has no freedom with respect to the degree of reduction because reeling and reduction must always be effected simultaneously.

In order to improve the quality of the inner surface, the inner tool is preferably continuously displaced in longitudinal direction during the entire rolling process. The advantage to this method is that the scale obtained upon the customary hot rolling cannot build up at any given place and thus lead to disturbances in the rolling process.

Alternatively, the inner tool may be displaced only during a given phase of the rolling. These given phases of the rolling are preferably at the end rolling and the initial rolling, which are particularly critical to the distribution of the forces in the roll nip and are supported by the displacement of the inner tool.

The measure of displacing the inner tool upon the start rolling or end rolling has the purpose of avoiding start rolling or end rolling plugs. If the method is limited to these phases, then during the remaining rolling time one has the condition of a stationary inner tool with the danger of the scale building up. To avoid this, as noted above the inner tool preferably is also displaced during the remaining time.

It should be understood that the preferred embodiments and examples described are for illustrative purposes only and are not to be construed as limiting the scope of the present invention which is properly delineated only in the appended claims.

What is claimed is:

1. A method of manufacturing seamless pipes of medium-thick and thin walls from an elongated hollow body of limited length which is reshaped with a roll having a reeling part by rolling to the desired final dimension with only one rolling pass, said method comprising the steps of:

significantly reducing the diameter of the hollow body with only slight change in wall thickness; and reeling the inner surface of the hollow body with the use of an inner tool, said inner tool having a working part of greater length then the corresponding reeling part on the roll and being longitudinally displaceable relative to the hollow body and to said corresponding reeling part during at least a part of the rolling process so as to minimize material build up and disturbances.

2. The method according to claim 1 wherein, as seen in the direction of rolling, the entering hollow body is first reduced in diameter and directly thereupon the reeling of the inner surface takes place.

3. The method according to claim 1 wherein the inner tool is continuously displaced in longitudinal direction during the entire rolling process.

4. A method for the manufacture of seamless pipes of medium-thick and thin walls from a heated elongated hollow body which is reshaped by a roll having a reeling part with two successive different rolling methods to the desired final dimension and then cooled, comprising in a first rolling process with only one rolling pass, said method comprising the steps of:

significantly reducing the diameter of the hollow body with only slight change in the wall thickness;

reeling the inner surface of the hollow body with the use of an inner tool, said inner tool being longitudinally displaceable during the rolling process so as to minimize material build up and disturbances, the axis of the hollow body being aligned during the rolling with the axis of rolling; and calibrating the hollow body to the desired final dimensions in a second rolling process.

5. A rolling device, comprising a piercing rolling mill having two rolls which are driven in the same direction and have an inlet part and an outlet part and are inclined by a transport angle to the axis of rolling and a guide arranged in a plane turned 90° from the rolling plane and an inner tool fastened to a holding bar and having a working part, wherein, as seen in the direction of rolling, each of the rolls has a feed part for feeding a hollow body which is followed by a reducing part with a reduction angle within the range of more than 2° up to 10°, with a transition in the form of a circular arc between said reducing part and a cylindrical reeler part, the cylindrical reeler part having a difference angle to the working part of the inner tool within the range of 0° to 1.0°, which is followed then by an outlet part for rounding, and wherein the guide has two fixed guide straightedges which lie opposite each other and the working part of the inner tool has a greater length than the reeling part of the rolls, wherein, seen in the direction of rolling, the starting end of the working part of the inner tool lies in front of the start of the reeling part of the rolls, with said inner tool being longitudinally displaceable relative to the hollow body and to the corresponding reeler part on said roll during at least part of the rolling process so as to minimize material build up and disturbances.

6. The rolling device according to claim 5, wherein the angle of reduction in the reducing part of the rolls is 3°-5°.

7. The rolling device according to claim 5, wherein as seen in the direction of rolling, the feed part has a feed angle of about 1° and is arranged in front of the reducing part.

8. The rolling device according to claim 5, wherein the axes of the rolls have a spread angle with respect to the axis of rolling.

9. The rolling device according to claim 8, wherein the point of intersection of the axes of the rolls with the rolling axis, seen in the rolling direction, lies behind the rolling mill.

10. The rolling device according to claim 9, wherein the size of the spread angle is so selected that for the average diameter of a predetermined range of dimensions in the reducing part the circumferential speed of the rolls decreases proportionally to the decrease in the diameter of the hollow body.

11. The rolling device according to claim 5, wherein the inner tool, in addition to the cylindrical working part, further comprises, a conically developed section, which is designed to rest against the inner surface of the hollow body to be rolled only during the final or initial rolling and the cone angle of which is substantially equal to the reduction angle of the rolls.

12. The rolling device according to claim 11, wherein the working part of the inner tool for the reeling has a continuation in the direction opposite the direction of rolling, the continuation extending over half the length of the reducing part of the roll which is adjoined, with a rounded shoulder, by a convergently conically developed initial rolling part which is designed so that during the rolling, the initial rolling part rests against the inner surface of the entering hollow body and the cone angle of which is substantially equal to the reduction angle and which extends up into the initial region of the reducing part.

* * * * *